US008151597B2

(12) United States Patent
Shin et al.

(10) Patent No.: US 8,151,597 B2
(45) Date of Patent: Apr. 10, 2012

(54) REFRIGERATOR

(75) Inventors: Jong Min Shin, Busan (KR); Ju Hyun Kim, Jinhae (KR)

(73) Assignee: LG Electronics Inc., Seoul (KR)

( * ) Notice: Subject to any disclaimer, the term of this patent is extended or adjusted under 35 U.S.C. 154(b) by 533 days.

(21) Appl. No.: 11/969,050

(22) Filed: Jan. 3, 2008

(65) Prior Publication Data

US 2008/0156020 A1 Jul. 3, 2008

(51) Int. Cl.
*F25D 17/04* (2006.01)

(52) U.S. Cl. ..... 62/407

(58) Field of Classification Search ..... 62/405, 62/406, 407, 420, 425, 428, 344, 340
See application file for complete search history.

(56) References Cited

U.S. PATENT DOCUMENTS

| | | | | |
|---|---|---|---|---|
| 5,375,432 | A * | 12/1994 | Cur | 62/320 |
| 6,148,624 | A * | 11/2000 | Bishop et al. | 62/137 |
| 6,945,068 | B2 * | 9/2005 | Kim et al. | 62/353 |
| 2005/0061016 | A1 * | 3/2005 | Lee et al. | 62/340 |
| 2005/0061018 | A1 * | 3/2005 | Kim et al. | 62/344 |
| 2005/0210909 | A1 * | 9/2005 | Kim et al. | 62/340 |
| 2005/0252232 | A1 * | 11/2005 | Lee et al. | 62/340 |

FOREIGN PATENT DOCUMENTS

| | | | |
|---|---|---|---|
| KR | 1997-022173 | * | 5/1997 |
| KR | 1998-0028102 | * | 7/1998 |
| KR | 1020050100126 | * | 10/2005 |

* cited by examiner

*Primary Examiner* — Frantz Jules
*Assistant Examiner* — Emmanuel Duke
(74) *Attorney, Agent, or Firm* — Ked & Associates LLP

(57) ABSTRACT

The present invention relates to a refrigerator, and more particularly, to a cold air flow passage structure for allowing ice, which is received in an ice-storing device provided in a refrigerating chamber door, to be in a frozen state without being melted.

The refrigerator of the present invention comprises a main body including at least a refrigerating chamber and a cold air flow passage for supplying cold air to the refrigerating chamber, a refrigerating chamber door for opening or closing the refrigerating chamber, a shelf provided in the refrigerating chamber, and a container provided in the refrigerating chamber door to store ice therein, wherein the cold air flow passage extends forward along the shelf so that cold air is discharged to the container.

According to the refrigerator of the present invention, even though an ice bank for storing ice is provided in a refrigerating chamber door, it is possible to prevent a phenomenon by which ice is partially melted and stuck again together.

Further, since ice is not partially melted and stuck again together, it is possible to prevent a phenomenon by which an overload is applied to an ice crusher provided in the ice bank.

18 Claims, 3 Drawing Sheets

REFRIGERATOR

BACKGROUND OF THE INVENTION

1. Field of the Invention

The present invention relates to a refrigerator, and more particularly, to a cold air flow passage structure for allowing ice, which is received in an ice-storing device provided in a refrigerating chamber door, to be in a frozen state without being melted.

2. Description of the Related Art

Generally, a refrigerator is an electric home appliance for storing foods in a low temperature state so that the foods can be kept in a fresh state for an extended period of time.

Specifically, a refrigerator includes a refrigerating chamber that is maintained in a temperature range of 1 to 4° C. to store foods such as vegetables in a fresh state, and a freezing chamber that is maintained at about −18° C. to store foods such as meat or fish in a frozen state.

In addition, refrigerators are classified into a type in which a freezing chamber is positioned above a refrigerating chamber, a type in which a freezing chamber is positioned below a refrigerating chamber, and a type in which a freezing chamber and a refrigerating chamber are positioned side by side.

Alternatively, refrigerators may be classified into a side-by-side door refrigerator having right and left doors, and a single-side door refrigerator having upper and lower doors.

Meanwhile, an ice maker for making ice and an ice bank for storing the ice are provided in any one of the refrigerating chamber and the freezing chamber.

Specifically, in a case where the ice maker and the ice bank are provided in the freezing chamber, water stored in the ice maker is made into ice by means of a refrigerant that has passed through an evaporator, and the ice falls into and stored in the ice bank provided below the ice maker.

Meanwhile, in some refrigerators, the ice maker is provided in the refrigerating chamber, and the ice bank is provided at a refrigerating chamber door. In this case, since the refrigerating chamber is kept at a temperature above zero, the ice stored in the ice bank may be melted and stuck together.

Specifically, in a case where ice is melted and stuck together, there is a problem in that an overload may be applied to an ice crusher provided in the ice bank. More specifically, in a case where an overload is applied to the ice crusher, parts such as a motor for operating the ice crusher or a blade for crushing ice may be damaged. As a result, there is a disadvantage in that the life span of the ice bank is shortened, resulting in additional repair or replacement costs.

SUMMARY OF THE INVENTION

The present invention is conceived to solve the aforementioned problems. Accordingly, an object of the present invention is to provide a refrigerator, wherein ice stored in an ice bank provided at a refrigerating chamber door is kept in a frozen state without being melted.

Specifically, an object of the present invention is to provide a refrigerator, wherein ice stored in an ice bank is prevented from being melted and stuck together so that an ice crusher for crushing the ice is not damaged.

A refrigerator according to one aspect of the present invention for achieving the objects comprises a main body including at least a refrigerating chamber and a cold air flow passage for supplying cold air to the refrigerating chamber, a refrigerating chamber door for opening or closing the refrigerating chamber, a shelf provided in the refrigerating chamber, and a container provided in the refrigerating chamber door to store ice therein, wherein the cold air flow passage extends forward along the shelf so that cold air is discharged to the container.

A refrigerator according to another aspect of the present invention comprises a door for opening or closing a refrigerating chamber, a container provided in an inner surface of the door to store ice therein, a shelf provided in the refrigerating chamber, and a cold air duct extending into the refrigerating chamber along one side of the shelf and having a discharge port formed toward the container.

With the structure described above, there is an advantage in that ice stored in the ice bank provided at the refrigerating chamber door can be kept in a frozen state without being melted.

BRIEF DESCRIPTION OF THE DRAWINGS

The above and other objects, features and advantages of the present invention will become apparent from the following description of a preferred embodiment given in conjunction with the accompanying drawings, in which.

DESCRIPTION OF THE PREFERRED EMBODIMENT

Hereinafter, a specific embodiment of the present invention will be described in detail with reference to the accompanying drawings. However, the spirit of the present invention is not limited to the following embodiment, and retrograde embodiments or other embodiments included in the scope of the present invention can be easily conceived by adding, changing or eliminating other components.

Figure 1:
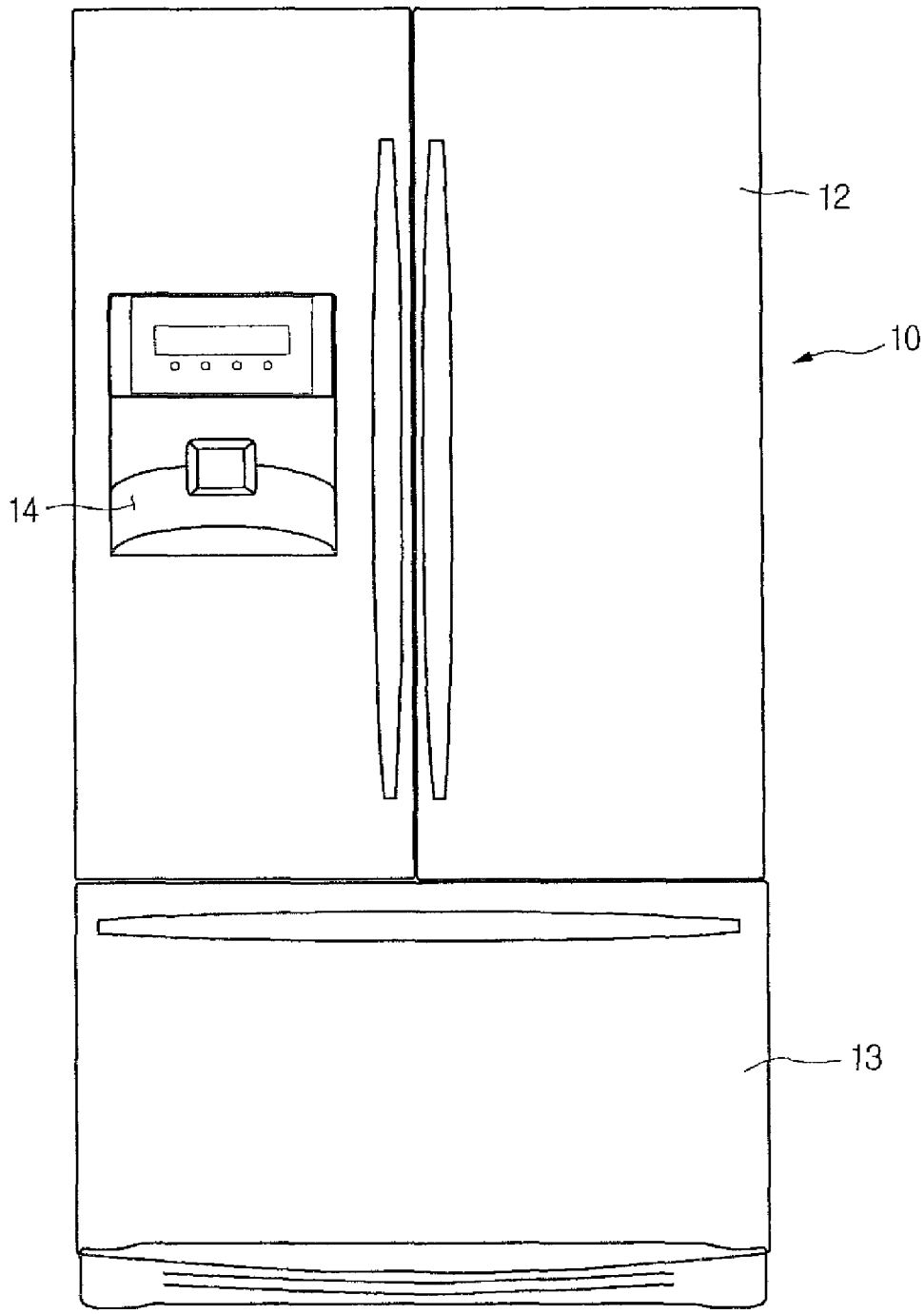
FIG. 1 is a front view of a refrigerator according to the present invention.
Figure 2:
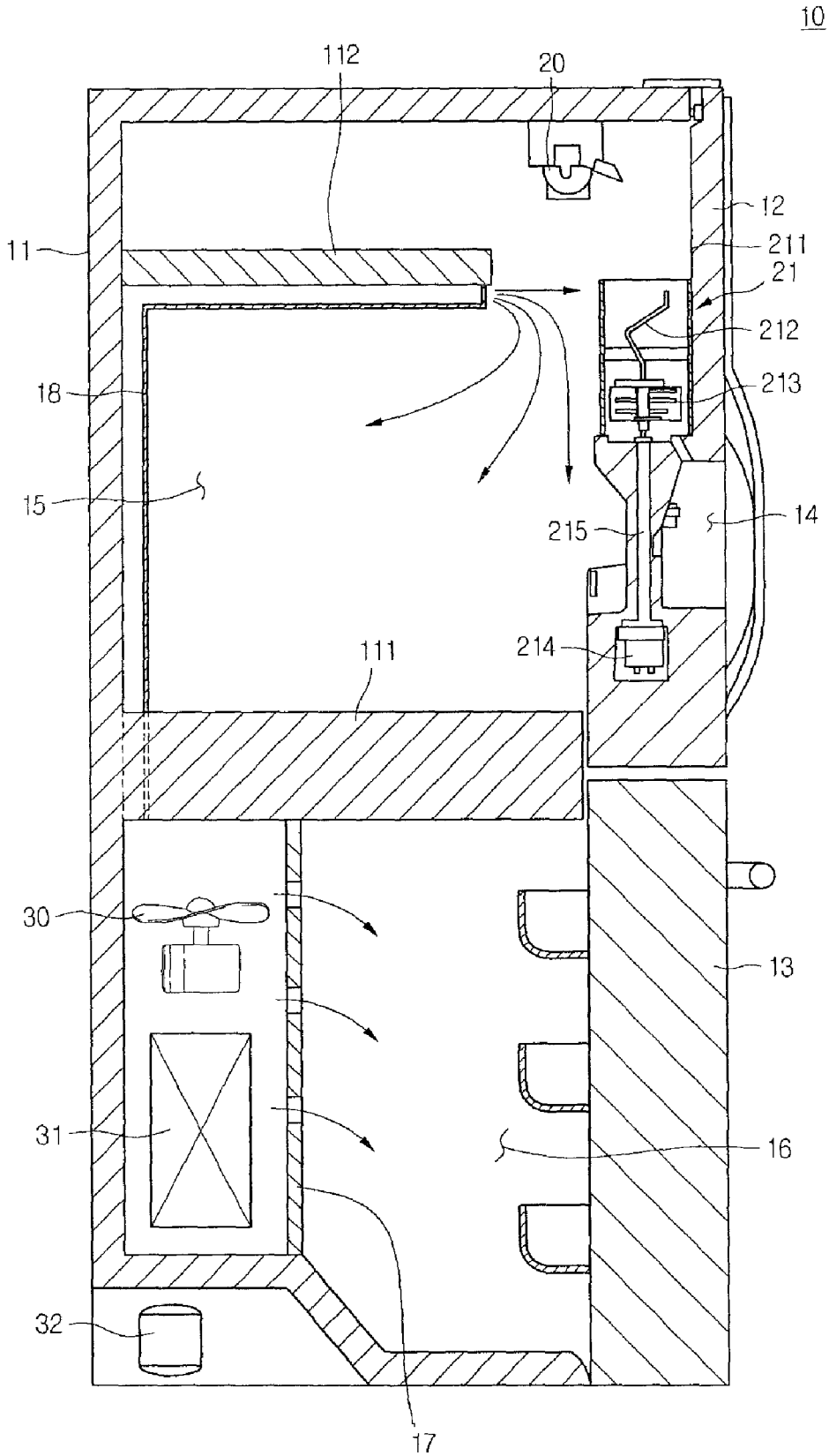
FIG. 2 is a side sectional view showing the refrigerator according to the present invention.
Figure 3:
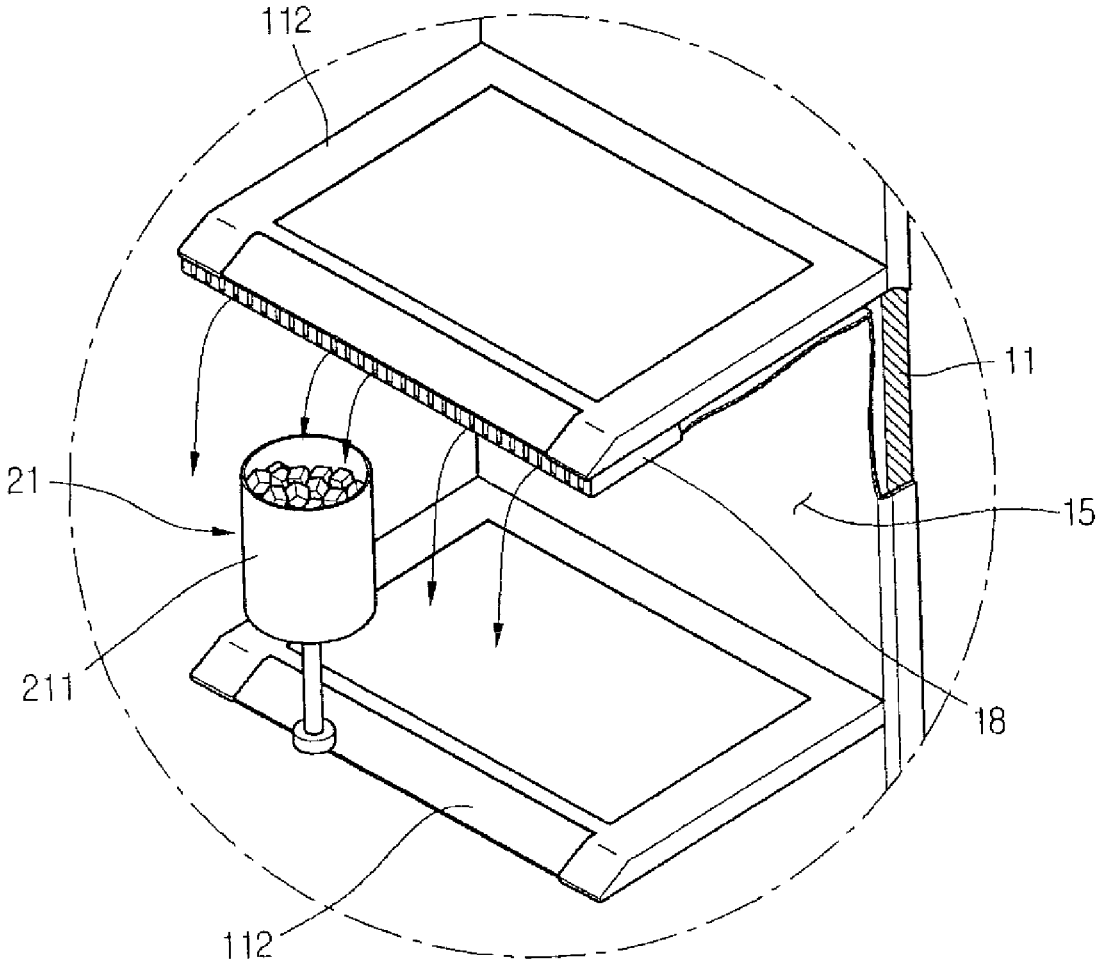
FIG. 3 is a schematic view showing a cold air discharging structure of the refrigerator according to the present invention.

FIG. 1 is a front view of a refrigerator according to the present invention, FIG. 2 is a side sectional view showing the refrigerator according to the present invention, and FIG. 3 is a schematic view showing a cold air discharging structure of the refrigerator according to the present invention.

Referring to FIGS. 1 to 3, the refrigerator of the present invention will be described by way of example in connection with a bottom-freezer type refrigerator in which a refrigerating chamber is provided at an upper portion and a freezing chamber is provided at a lower portion.

The refrigerator 10 of the present invention includes a main body 11 having a refrigerating chamber 15 and a freezing chamber 16 provided therein, refrigerating chamber doors 12 for opening or closing the refrigerating chamber 15, and a freezing chamber door 13 for opening or closing the freezing chamber 16. Specifically, the refrigerating chamber 15 and the freezing chamber 16 are partitioned by means of a barrier 111.

In addition, the refrigerator 10 further includes a compressor 32 provided at a lower portion of the main body 11 to compress a refrigerant, an evaporator 31 disposed at a rear portion of the main body 11 to generate cold air, and a blower fan 30 for causing the cold air generated by the evaporator 31 to be supplied into the refrigerating chamber 15 and the freezing chamber 16.

Moreover, the refrigerator 10 further includes a freezing duct 17 for supplying the cold air blown by the blower fan 30 to the freezing chamber 16, a refrigeration duct 18 for supplying the cold air to the refrigerating chamber 15, an ice maker 20 provided on a ceiling of the refrigerating chamber 15, and an ice bank 21 for storing ice made by the ice maker 20.

Specifically, the freezing duct 17 is provided with a plurality of cold air holes, and the cold air is discharged into the freezing chamber 16 through the cold air holes. Here, in addition to the structure in which the evaporator 31 and the blower fan 30 are disposed in the freezing duct 17, the evaporator 31 and the blower fan 30 may be provided in a separate space in the main body 11 and a freezing duct 17 connected to the freezing chamber 16 may be separately provided.

Meanwhile, a shelf 112 on which foods or vessels are to be placed is provided in the refrigerating chamber 15, and the refrigeration duct 18 extends forward along a downside surface of the shelf 112.

Specifically, the refrigeration duct 18 extends from a space where the evaporator 31 is accommodated, and is then connected to the refrigerating chamber 15 through the barrier 111. More specifically, the refrigeration duct 18 extends upward along a rear surface of the refrigerating chamber 15 and then extends forward along the downside surface of the shelf 112. In addition, discharge ports provided at an end of the refrigeration duct 18 are positioned above the ice bank 21. Thus, a portion of the cold air discharged from the refrigeration duct 18 is discharged toward the ice bank 21, and the remainder of the cold air circulates in the refrigerating chamber 15.

Here, in addition to the structure in which the refrigeration duct 18 communicates directly with the space with the evaporator 31 accommodated therein, it should be noted that the refrigeration duct 18 may be branched off from the freezing duct 17.

As shown in the figures, the refrigerating chamber doors 12 are generally provided as side-by-side doors, and the freezing chamber door 13 is generally in the form of a drawer-type door. However, the freezing chamber door 13 may also be provided in the form of side-by-side doors.

With the structure described above, ice made by the ice maker 20 provided on the ceiling of the refrigerating chamber 15 is separated by an ejector (not shown) and then falls into the ice bank 21. Here, a guide extending from the ice maker 20 or the ice bank 21 may be provided such that the ice separated from the ice maker 20 can safely fall into the ice bank 21.

Meanwhile, the ice bank 21 has an upper face in the form of an opening, and the opening is positioned below the ice maker 20 when the refrigerating chamber doors 12 are closed. In addition, ice may be made by supplying cold air directly to the ice maker 20 or by providing an additional refrigerant conduit to the ice maker.

The ice bank 21 further includes a cylindrical container 211 with an open upper portion, an auger 212 provided at an inner lower portion of the container 211 to guide ice downward, a crusher 213 integrally connected to a lower end of the auger 212 to crush ice, a motor 214 for driving the crusher 213, and a shaft 215 for connecting the motor 214 to the crusher 213 so as to transmit a rotational force of the motor.

Furthermore, the ice maker 20 is provided at a side of the ceiling of the refrigerating chamber 15. Specifically, the ice maker 20 is positioned above the ice bank 21 such that ice discharged from the ice maker 20 can fall into the container 211.

Here, since any kind of ice maker can be used as the ice maker 20, a detailed description of the structure thereof will be omitted.

Meanwhile, in addition to the structure in which the refrigeration duct 18 extending toward the container 211 of the ice bank 21 extends along the downside surface of the shelf 112 as shown in the figures, the refrigeration duct 18 may extends along a top or side surface of the shelf 112. In other words, the arrangement of the refrigeration duct 18 can be properly determined according to the mounting position of the ice bank 21 provided in the refrigerating chamber door 12.

For example, in a case where the ice bank 21 is mounted at an edge of the refrigerating chamber door 12, the refrigeration duct 18 may extend along the side surface of the shelf 112.

Further, a discharging end of the refrigeration duct 18 is preferably inclined at a predetermined angle such that cold air is discharged downward. This is to cause the discharged cold air to be discharged directly into the container 211 of the ice bank 21. That is, at least a portion of cold air, which has been cooled to a lower temperature while passing through the evaporator 31, is discharged directly into the container 211, thereby effectively preventing a phenomenon by which ice accommodated in the container 211 is melted and stuck together.

Moreover, if cold air is discharged downward, it is possible to obtain an air curtain effect. Thus, the amount of cold air escaping from the refrigerating chamber upon opening of the refrigerating chamber door can be reduced.

According to the refrigerator of the present invention constructed as above, even though an ice bank for storing ice is provided in a refrigerating chamber door, it is possible to prevent a phenomenon by which ice is melted and stuck together.

Further, since ice is not melted and stuck together, it is possible to prevent a phenomenon by which an overload is applied to an ice crusher provided in the ice bank.

In addition, since an overload is not applied to the ice crusher, components such as a motor for driving the ice crusher or a blade for crushing ice are not damaged. Thus, the life span of the ice bank is extended and additional repair and replacement costs are not required.

Moreover, since an end of a refrigeration duct is provided at a front portion of the refrigerating chamber, discharged cold air forms an air curtain.

Furthermore, cold air supplied through the evaporator is used to keep ice, which is stored in the ice bank exposed to the refrigerating chamber, in a frozen state, without using any additional ice preserving device, resulting in reduction of manufacturing costs of the refrigerator.

What is claimed is:

1. A refrigerator, comprising:

a main body including at least a refrigerating chamber and a freezing chamber disposed under the refrigerating chamber;

a first and second refrigerating chamber doors for opening or closing the refrigerating chamber;

at least a shelf provided in the refrigerating chamber;

an ice maker disposed within the refrigerating chamber so as to be located behind the first refrigerating chamber door;

a container mounted on the first refrigerating chamber door so as to be supplied with ice from the ice maker, wherein an interior of the container communicates with an interior of the refrigerating chamber;

a dispenser disposed in the first refrigerating chamber door so as to dispense the ice received in the container; and a cold air duct for supplying the cold air to the container in order to maintain the ice in the container in a frozen state, wherein:

at least a portion of the cold air duct extends substantially parallel to the shelf and is coupled to one or more openings on or adjacent a front side of the shelf, cold air from the cold air duct flows to the container through the one or more openings arranged on or adjacent the front side of the shelf, the one or more openings are arranged in a direction substantially parallel to the front side of the shelf for a first width, the container has a second width in said direction, and the first width is greater than the second width.

2. The refrigerator as claimed in claim 1, wherein the cold air duct communicates with a space where an evaporator to produce cold air is accommodated.

3. The refrigerator as claimed in claim 1, wherein the cold air duct is provided at any one of a top surface, a bottom surface, or a side surface of the shelf.

4. The refrigerator as claimed in claim 1, wherein a discharging end that includes the one or more openings of the cold air duct is inclined at a predetermined angle so as to discharge cold air.

5. The refrigerator as claimed in claim 1, wherein the container is disposed under the ice maker.

6. The refrigerator as claimed in claim 1, wherein the cold air duct and shelf are located between the ice maker and the container.

7. The refrigerator as claimed in claim 1, wherein the first width extends from a first side edge of the shelf to a second side edge of the shelf.

8. The refrigerator as claimed in claim 7, wherein the first width is substantially equal to a width of the front side of the shelf.

9. The refrigerator as claimed in claim 1, wherein the front side corresponds to a front edge of the shelf.

10. The refrigerator as claimed in claim 1, wherein cold air from the cold air duct flows through a plurality of openings on or adjacent a front side of the shelf.

11. The refrigerator as claimed in claim 1, wherein the direction which is substantially parallel to the front side of the shelf crosses a direction in which the cold air duct extends on or along the shelf.

12. A refrigerator, comprising:

a main body including at least a refrigerating chamber and a freezing chamber disposed under the refrigerating chamber;

a first and second refrigerating chamber doors for opening or closing the refrigerating chamber;

at least a shelf provided in the refrigerating chamber;

an ice maker disposed within the refrigerating chamber so as to be located behind the first refrigerating chamber door;

a container mounted on the first refrigerating chamber door so as to be supplied with ice from the ice maker and to be exposed to an interior of the refrigerating chamber;

a dispenser disposed in the first refrigerating chamber door so as to dispense the ice received in the container;

an evaporator disposed within the freezing chamber to supply cold air; and a cold air flow passage for supplying the cold air from the freezing chamber to the container in order to maintain the ice in the container in a frozen state, wherein:

the cold air flow passage extends along the shelf and includes a terminal end arranged along or adjacent a front edge of the shelf, the terminal end includes one or more openings for discharging cold air from the cold air flow passage to the container, and the one or more openings extend along or adjacent the front edge of the shelf for a first width greater than a second width of the container.

13. The refrigerator as claimed in claim 12, wherein the cold air flow passage is a cold air duct extending along a bottom surface or a side surface of the shelf.

14. The refrigerator as claimed in claim 12, wherein the cold air flow passage supplies cold air to the container and the refrigerating chamber.

15. The refrigerator as claimed in claim 12, wherein the one or more openings are coupled to the cold air flow passage and are positioned at a level which is substantially equal to or higher than a level that corresponds to an opening of the container.

16. The refrigerator as claimed in claim 12, wherein an ice maker is coupled to a ceiling of the refrigerating chamber.

17. The refrigerator as claimed in claim 16, wherein the container is disposed under the ice maker.

18. The refrigerator as claimed in claim 12, wherein the dispenser includes an opening through which the ice is supplied, the opening located on an outer surface of the first refrigerating chamber door.

* * * * *